US005341972A

United States Patent [19]

Jacks

[11] Patent Number: 5,341,972

[45] Date of Patent: Aug. 30, 1994

[54] WRIST WATCH WALLET

[76] Inventor: R. Benton Jacks, P.O. Box 69445, Seattle, Wash. 98168

[21] Appl. No.: 106,398

[22] Filed: Aug. 12, 1993

[51] Int. Cl.[5] ..... A45C 15/08

[52] U.S. Cl. ..... 224/165; 224/219; 224/222; 224/249

[58] Field of Search ..... 224/165, 164, 152, 219, 224/222, 249, 267

[56] References Cited

U.S. PATENT DOCUMENTS

| | | | |
|---|---|---|---|
| 1,972,480 | 9/1934 | Gomi | 224/222 |
| 2,400,222 | 2/1945 | Cline | 224/165 |
| 3,189,073 | 6/1965 | Todd | 224/222 |
| 3,670,933 | 6/1972 | Jones . | |
| 4,047,651 | 9/1977 | McMullen . | |
| 4,239,136 | 12/1980 | Godwin | 224/219 |
| 4,461,030 | 7/1984 | Knudson | 224/222 |

FOREIGN PATENT DOCUMENTS

| | | | |
|---|---|---|---|
| 3023668 | 1/1982 | Fed. Rep. of Germany | 224/219 |
| 4604 | of 1894 | United Kingdom | 224/219 |

OTHER PUBLICATIONS

Jogalite—reflective wrist wallet—photo & photocopy.

*Primary Examiner*—Renee S. Luebke

*Attorney, Agent, or Firm*—Craine & Jackson

[57] ABSTRACT

A wrist watch wallet is disclosed having a main band with a watch attached to the outer surface thereof. The main band is designed to conveniently store in a concealed manner such items as currency, keys, and event tickets. The main band is made of thin, flexible, fashionable material and has sufficient length so that it may be wrapped in an overlapping manner around the user's wrist. Attached to the opposite ends of the main band are complimentary primary hook and loop connector pads which are interconnected to hold the main band in place around the user's wrist. During manufacturing, a longitudinally aligned full length opening is formed on the rear surface of the main band which allows access to the full length, longitudinally aligned main pocket formed therein. One end of the main band is closed while the opposite end is opened thereby providing a transversely aligned opening into the main pocket. Attached along the closed end of the main band is a inward curved, rigid insert member which acts to improve the gripping strength of the primary hook and loop connector pads during use. Also manufactured inside the main band is an optional second pocket used to carry smaller objects. Key pockets are also provided for carrying keys.

12 Claims, 5 Drawing Sheets

WRIST WATCH WALLET

BACKGROUND OF THE INVENTION b 1. Field of the Invention

This invention relates to watch bands and, more particularly, to watch bands capable of functioning as a billfold or purse.

2. Description of the Related Art

Various wrist bands have been used in the past for conveniently carrying currency or other various objects on a user's wrist. One problem with such wrist bands is that they do not allow paper currency to be stored and carried in a longitudinally aligned, flat position inside the wrist band for easy retrieval. Another problem with such wrist bands is that the main pocket which holds the currency does not automatically close when the wrist band is worn around the wrist. A further problem with such wrist bands, is that they do not allow keys and currency to be stored and carried simultaneously.

In Cline, U.S. Pat. No. 2,400,222, a concealing wrist purse is disclosed comprising a flexible band having an interior pocket with a zipper closing means. The wrist purse includes a loop formed on the outer surface of the band which is capable of engaging one side pintle of a wrist watch. An elongated tongue having a stiff tip is attached on the opposite side of the flexible band which can be looped around the opposite side pintle of the wrist watch to hold the wrist watch on the band. One obvious problem with such a wrist purse is that it is relatively complex and expensive to manufacture. Another problem with the wrist purse disclosed in Cline is that due to its design, the opening to the pocket is limited to the area between the tongue and the buckle. As a result, the pocket is relatively narrow and short which makes storage of larger objects therein, such as currency, difficult.

SUMMARY OF THE INVENTION

It is an object of the present invention to provide a wrist watch wallet capable of being securely attached to a user's wrist.

It is another object of the present invention to provide such a wrist watch wallet that is capable of simultaneously carrying various objects such as currency, keys, business cards and event tickets, in a convenient, concealed manner.

It is still another object of the present invention to provide such a wrist watch wallet having a concealed, full length main pocket designed to retain various elongated objects and which automatically closes when worn without using zippers or other fasteners.

It is a further object of the present invention to provide such a wrist watch wallet that is fashionable and inexpensive to manufacture.

These and other objects of the present invention are met by providing a wrist watch wallet comprising a main band capable of being wrapped around a user's wrist. The main band, which is designed to conveniently store in a concealed manner such items as currency, keys, business cards and event tickets, is rectangular in shape and made of thin, flexible, fashionable material. The main band has a sufficient length so that its opposite ends may be overlapped to secure it around the user's wrist. Complimentary primary hook and loop connector pads are attached to the opposite ends of the main band which are interconnected during use to securely hold the main band in place.

Located inside the main band is a longitudinally aligned pocket designed to hold currency or other thin elongated objects, such as tickets or other pieces of paper or plastics. In the preferred embodiment, the main band comprises a single sheet of flexible, rectangular-shaped material folded into an elongated billfold structure. The central portion of the flexible material forms a front panel while the upper portion is folded downward over the inside surface of the front panel to form the upper longitudinal edge of the main band and a top rear flap. The lower portion of the flexible material is folded upward over the inside surface of the front panel to form the main band's lower longitudinal edge and a rear bottom flap. During assembly, the top and bottom flaps are bent over the inside surface of the front panel so that their abutting edges converge to form a full length opening located approximately $\frac{1}{3}$ the width of the main band below the top edge. The lateral edges of the top and bottom flaps are attached to the adjoining lateral edge of the front panel to form a partially closed longitudinally aligned main pocket. By providing such a main pocket with an opening that extends the entire length of the main band, a user can easily insert and remove flat, elongated objects from the wrist watch wallet. In addition to providing this opening to the main pocket, a transverse opening is also provided to the main pocket by keeping the lateral edges of the top and bottom rear flaps and the front panel along one edge of the main band unattached.

Manufactured inside the closed end of the main band beneath the primary hook connector pad is a tapered, curved rigid insert member which acts as a stiffener designed to improve the gripping strength of the primary hook connector pad to the primary loop connector pad during use. Also, in the preferred embodiment, the inside surface of the main band adjacent to the insert member is skived to form a thin edge profile to provide anti-snag characteristics. Also attached to the outside surface of the bottom rear flap adjacent to the primary hook connector pad is an auxiliary hook connector pad which, during use, interconnects with the primary loop connector pad to prevent accidental disengagement of the main band from the user's wrist.

In addition to providing a main pocket, a plurality of other pockets are also provided with the wrist watch wallet for conveniently storing and carrying other objects. More specifically, a plurality of key pockets are provided for carrying keys. Each key pocket is easily created by manufacturing a longitudinally aligned slot on the front panel. Each slot is aligned along the longitudinal axis of the main band and centered between one of the channels created by the stitch pattern used to attach the primary loop connector pad to the front panel. Each slot is sufficiently wide so that the shank of a key may be inserted therein and retained in the channel in an aligned, transverse position on the main band. Also, openings may be created along the edges of the primary loop connector pad to enable the end of the shank of the key to extend through.

Also manufactured on the inside surface of the bottom rear flap is an optional, second pocket which can be used to store smaller objects, such as coin currency and medications in the main band.

A timepiece is attached to the front panel of the main band. The timepiece can be aligned along the main band's longitudinal axis or aligned to one side thereof.

The body of attachment means. In the preferred embodiment, the timepiece attachment means includes two U-shaped attachment clips which pierce and extend through the front panel. The U-shaped attachment clips are spaced apart so that their respective ends extend above the outside surface of the front panel to engage the opposite pair of lugs located on the body of the timepiece. In the preferred embodiment, the U-shaped attachment clips are slanted outward in opposite directions to prevent undesirable movement of the body of the timepiece on the front panel.

DESCRIPTION OF THE PREFERRED EMBODIMENT(S)

Figure 1:
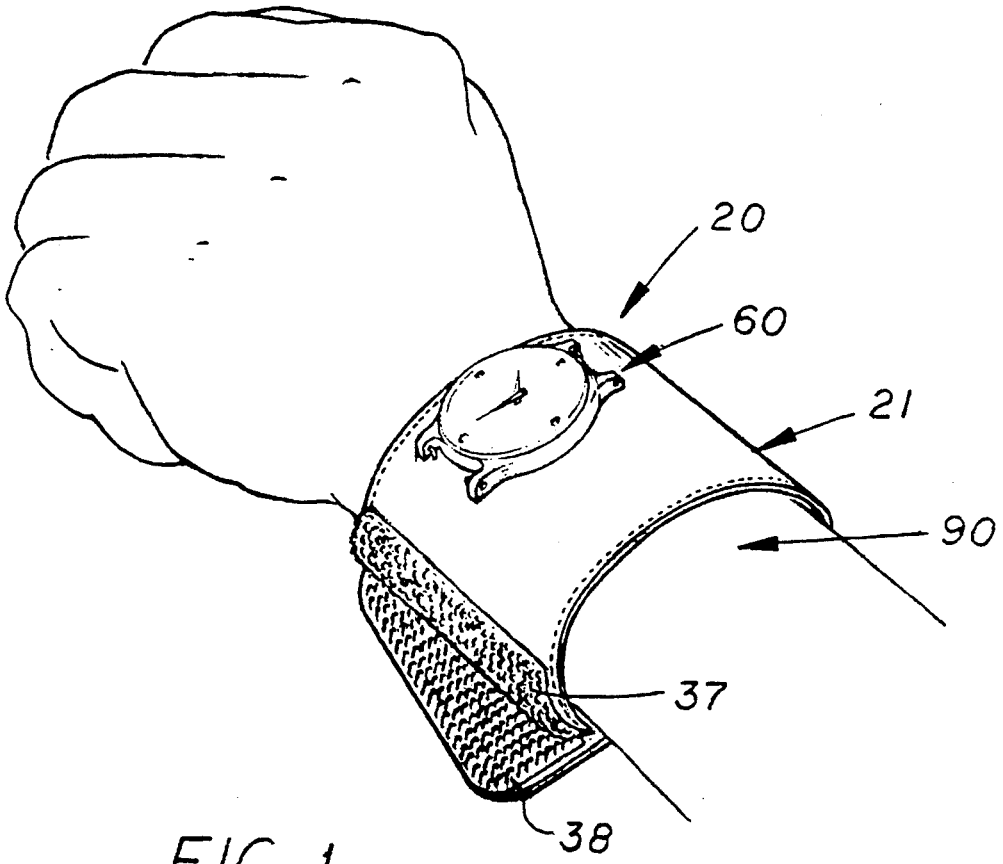
FIG. 1 is a perspective view of the wrist watch wallet worn around a user's wrist.

As shown in the accompanying FIGS. 1–13, there is described a wrist watch wallet, generally referred to as 20, designed to act as a combination wallet and wrist watch. The wrist watch wallet 20 is uniquely designed to conveniently store and carry in a concealed manner various useful items, such as currency, keys, and event tickets.

As shown more particularly in FIGS. 1–5, the wrist watch wallet 20 comprises an elongated, rectangular shaped main band 21 made of thin, flexible, fashionable material. The main band 21 has sufficient length so that its opposite first and second ends 30, 31, respectively, may be overlapped to wrap the main band 21 around the user's wrist 90. Complimentary primary loop and hook connector pads 37, 38, respectively, are attached on opposite sides of the main band 21 to the opposite first and second ends 30, 31, respectively. The primary loop connector pad 37 has sufficient width and length so it may be interconnected with the primary hook connector pad 38 when the main band 21 is wrapped around different wrist sizes.

Figure 7:
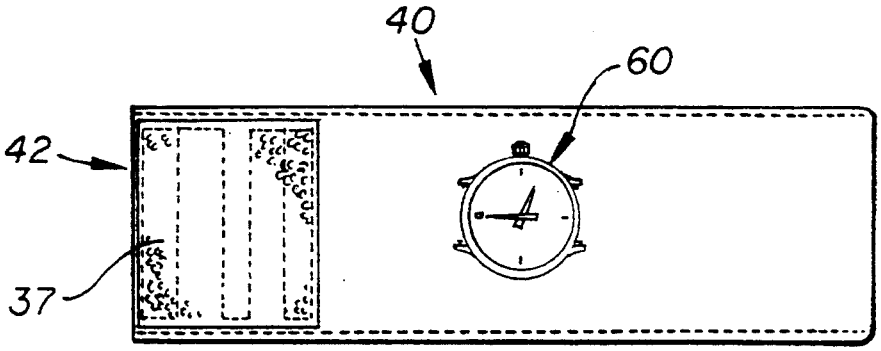
FIG. 7 is a front plan view of a second embodiment of the invention.

In FIGS. 1–5, a first embodiment of the invention is shown having a main band 21 made of durable, synthetic leather material and measuring approximately 9 inches in length and 3 inches in width for use by most adults and children. In FIG. 7, a second embodiment of the invention is shown having a narrow main band 42 measuring approximately 9 inches in length and 2 to 2½ inches in width. With both embodiments, the main bands 21, 42 are made of a single sheet of flexible, rectangular shaped material which is folded and sewn into an elongated billfold structure. As more clearly shown in FIG. 5, during assembly the central portion **21*a* of the flexible material forms the front panel 22 of the main band 21 while the upper portion 21*b* when folded and sewn in a downward extending position over the inside surface of the front panel 22 forms the upper edge 28 of the main band 21 and a narrow, rear top flap 32. During assembly, the lower portion 21*c* of the flexible material is also folded and sewn in an upward extending position over the inside surface of the front panel extending position over the inside surface of the front panel 22 to form the bottom edge 29 which is aligned parallel to the upper edge 28, and a wide, rear bottom flap 33. The second end 31 of the main band 21 is closed by attaching the lateral edge of the front panel 22 and the lateral edges of the top and bottom rear flaps 32, 33 together. When the top and bottom rear flaps 32, 33 are folded over, their abutting edges converge to form a full length, longitudinally aligned opening 34 which provides access to the main pocket 36 created inside the main band 21**.

During use, the opening 34 is concealed and automatically closed. Because the opening 34 and the main pocket 36 extends the entire length of the main band 21, flat, unfolded paper currency 94 may be stored therein thereby reducing the overall thickness of the wrist watch wallet 20. In addition, because opening 34 and the main pocket 36 are concealed, the wrist watch wallet 20 has the appearance of an ordinary wrist watch.

Figure 2:
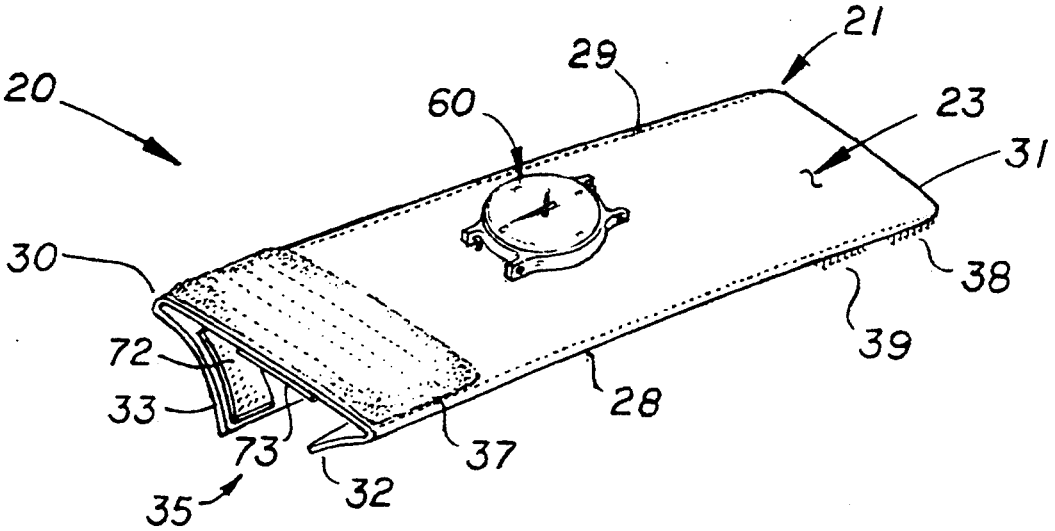
FIG. 2 is a perspective view of the wrist watch wallet.
Figure 3:
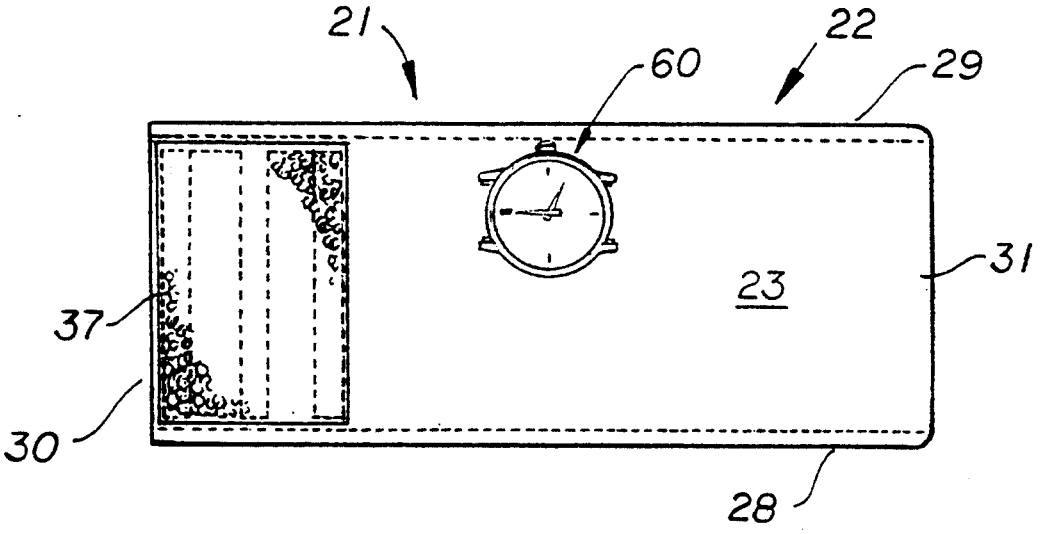
FIG. 3 is a front plan view of the wrist watch wallet.

The first end 30 of the main band 21 opposite the second end 31 is unattached thereby providing a transverse aligned opening 35 into the main pocket 36 as shown in FIG. 2. An optional, secondary pair of hook and loop connector pads 72, 73, respectively, as shown in FIG. 1, may be disposed along the first end 30 of the main band 21 between the inside surface of the front panel 22 and the inside surface of the bottom flap 33 which enables the user to selectively close the transverse opening 35 into the main pocket 36.

Figure 5:
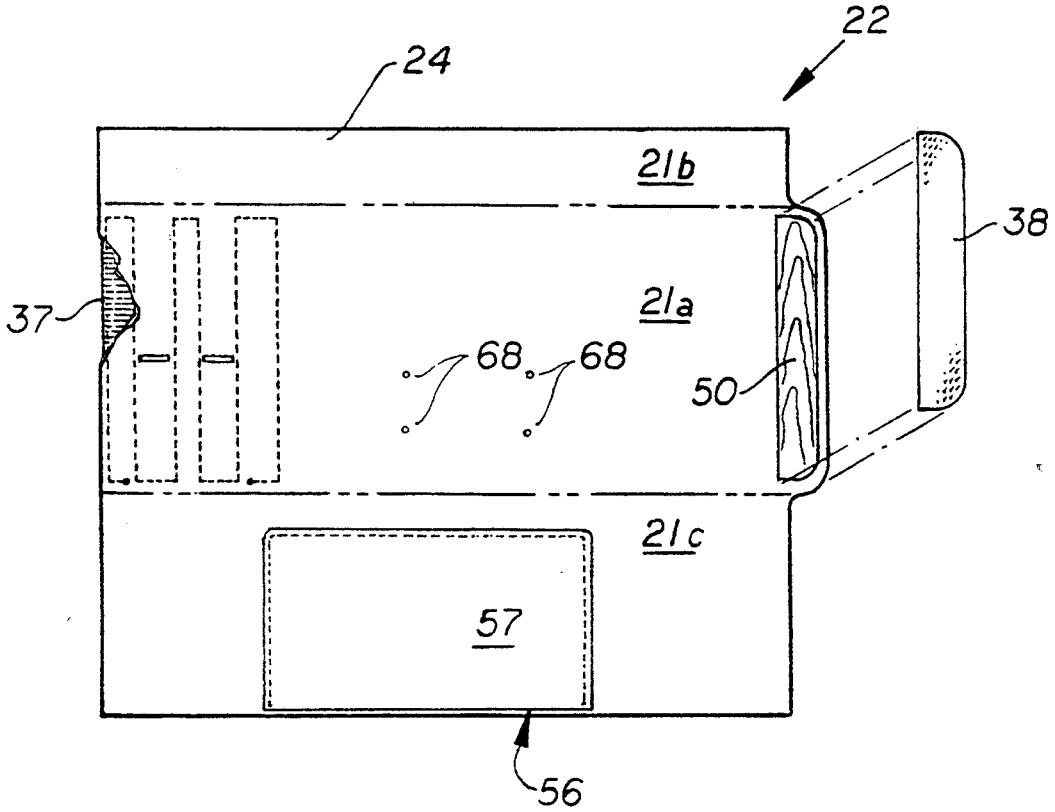
FIG. 5 is a rear plan view of the wrist watch wallet shown in an opened position for assembly.
Figure 6:
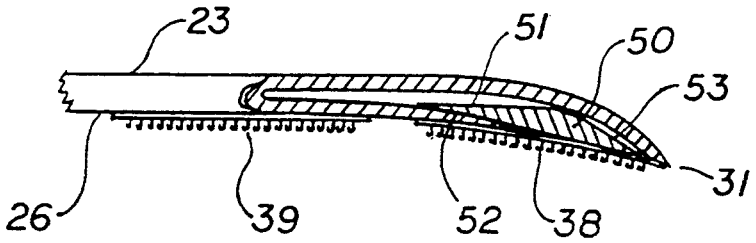
FIG. 6 is a side elevation view of a section of the wrist watch wallet showing the placement of the insert member inside the main band.

Attached to the inside surface of the main band 21 near the second end 31 is a primary hook connector pad 38 which, during use, interconnects with the primary loop connector pad 37. As shown in FIG. 5, attached inside the main band 21 along the second end 31 beneath the primary hook connector pad 38 is a tapered, curved, rigid insert member 50. The rigid insert member 50 acts as a stiffener designed to improve the gripping strength of the primary hook connector pad 38 and the adjoining primary loop connector pad 37. By providing such a feature, the cleavage strength, the peel strength, and the tension strength of the connector pads 37, 38 is greatly increased thereby reducing the possibility of their accidental disengagement during use. As shown in FIG. 6, in the preferred embodiment the insert member 50 has three angle surfaces 51, 52, 53, which act to bend the second end 31 of the main band 21 inward to improve attachment during use. Also, the inside surface 24 of the front panel 22 along the second end 31 adjacent to the insert member 50 is skived to form a thin edge profile to prevent accidental snagging during use. Another purpose of the insert member 50 is to provide a ledge for finger gripping the first end to tightening the main band 21 around the wrist.

Attached to the outside surface 26 of the bottom flap 33 adjacent to the primary hook connector pad 38 is an optional, auxiliary hook connector pad 39 which also interconnects with the primary loop connector pad 37 during use to prevent accidental removal of the wrist watch wallet 20 from the user's wrist.

Figure 8:
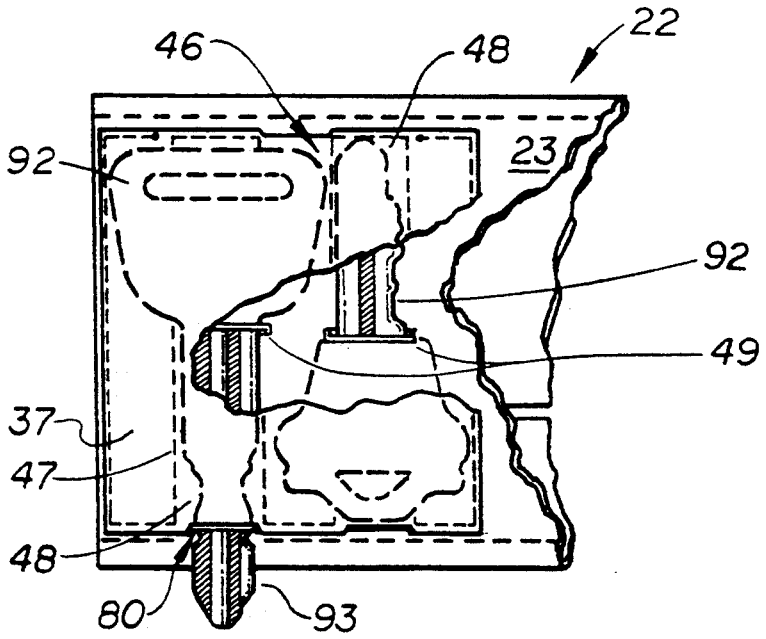
FIG. 8 is a partial top plan view in section showing the placement of the loop pad connector over the billfold body with two keys inserted through slots formed on the inside surface of the main band.
Figure 9:
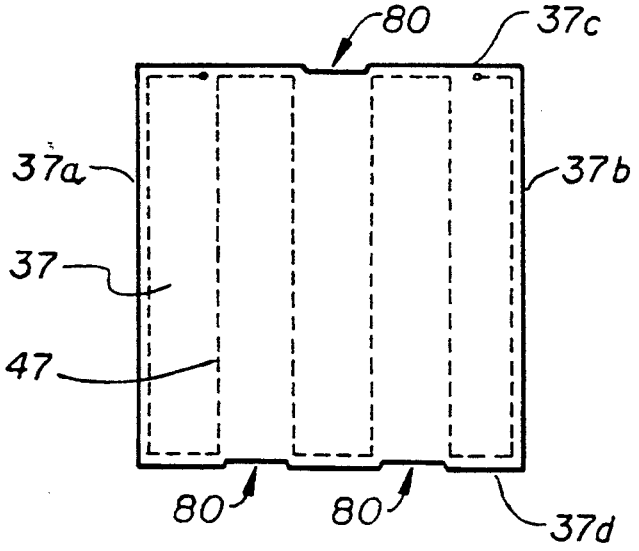
FIG. 9 is a plan view of the primary loop connector pad showing the stitching pattern thereon forming two channels therein for keys.
Figure 10:
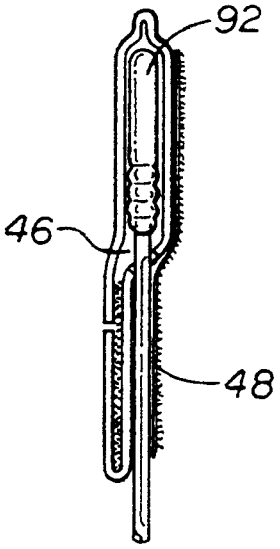
FIG. 10 is an end view of the main band with a key inserted into one of the channels shown in FIG. 9.

The primary loop connector pad 37 is attached to the outside surface 23 of the main band 21 adjacent to the first end 30. In the preferred embodiment, one or more key pockets 46 are manufactured inside the connector pad 37 which are used to store and carry keys. As shown in FIGS. 8–10, each key pocket 46 is transversely aligned on the main band 21 and formed by manufacturing longitudinally aligned slots 49 on the front panel 22 directly behind the primary loop connector pad 37. Each slot 49 has a sufficient width so that the shank 93 of a key 92 may be inserted therethrough. A channel 48 is created between the connector pad 37 and the front panel 22 for each slot 49. The channels 48 are formed by stitch patterns 47 used to attach the connector pad 37 to the front panel 22 as shown in FIG. 9. Using such a stitch pattern 47, the two lateral edges **37*a* and 37*b* of the primary loop connector pad 37 are attached directly to the front panel 22 while selected sections of the upper and lower edges 37*c*, 37*d* are attached alternately to the front panel 22. The stitch pattern 47 traverses the connector pad 37 to create two channels 48 therein each capable of receiving a key shank 93. By selecting attaching the upper and lower edges 37*c* and 37*d* in the manner shown, openings 80 are created along the edges 37*c* and 37*d* which allow the ends of the key shank 93 to extend from beneath the primary loop connector pad 37**.

Figure 4:
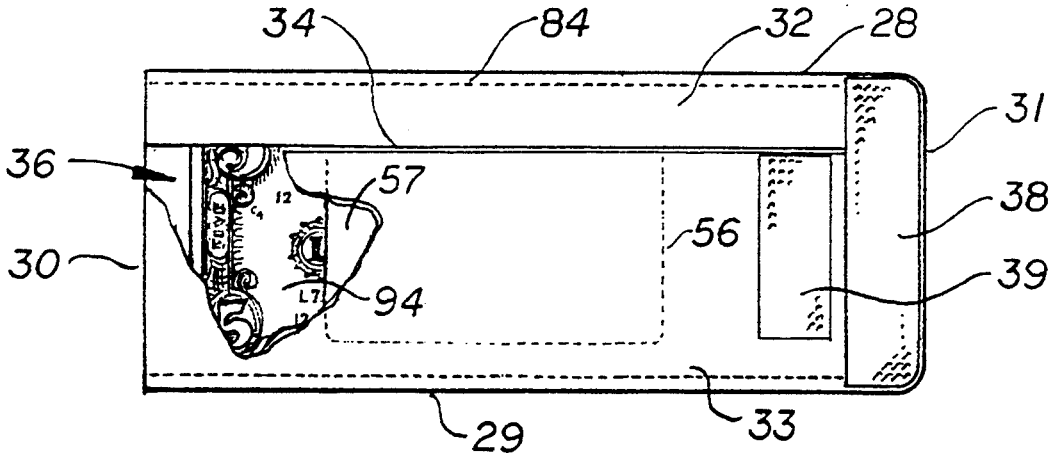
FIG. 4 is a rear plan view of the wrist watch wallet shown in FIGS. 1–3.

As shown in FIGS. 4 and 5, the wrist watch wallet 20 has an optional small second pocket 56 manufactured on the inside surface of the bottom flap 33. The second pocket 56, which is designed to carry smaller objects, such as coin currency or medications, is formed by attaching three edges of a pocket cover 57 to the inside surface of the bottom flap 33.

Attached to the outside surface 23 of the front panel 22 is a timepiece 60. In the preferred embodiment, the timepiece 60 is attached using a novel attachment means described further below. It should be understood, however, that the timepiece 60 may be attached by other means such as suitable adhesives. In the embodiment shown in FIGS. 1 and 2, the timepiece 60 is aligned longitudinally on the main band 21 near the bottom edge 29. By attaching the timepiece 60 near the bottom edge 29, the wrist watch wallet 20 has the appearance of a typical wrist watch when partially concealed by the cuff of shirt or coat. In other embodiments which use the narrow main band 42, as shown in FIGS. 7, the timepiece 60 may be attached centrally thereon.

Figure 11:
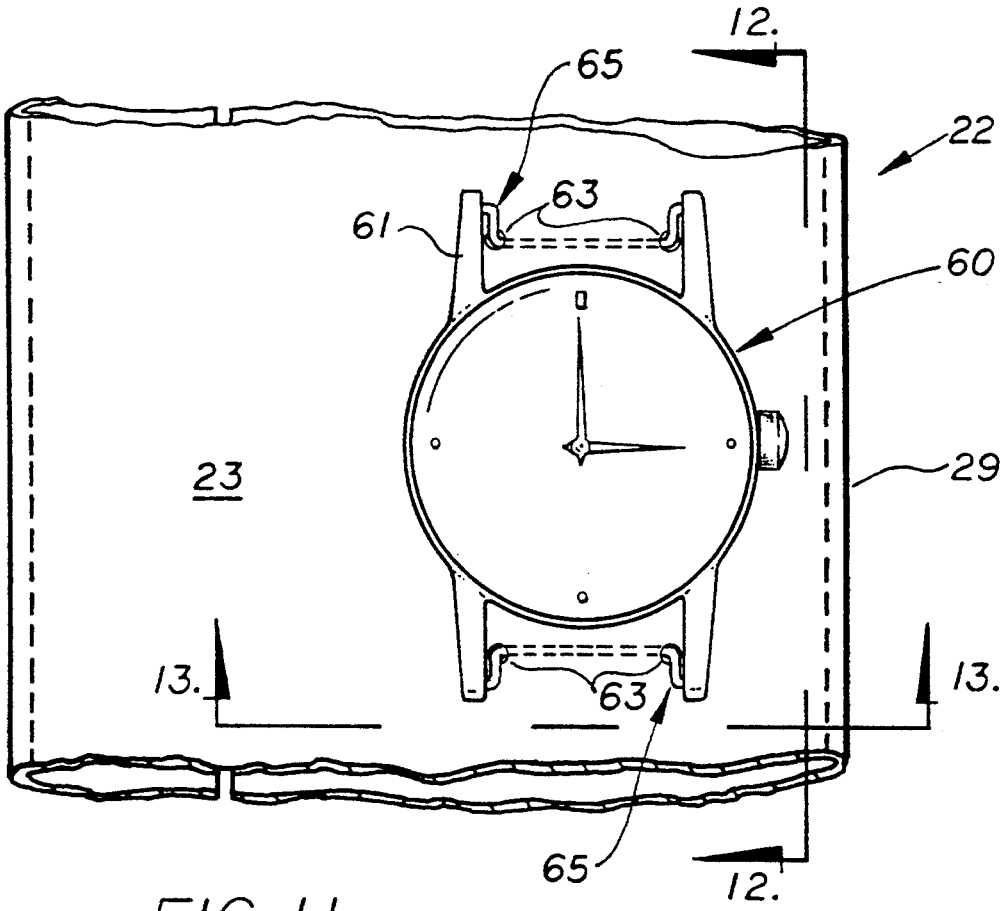
FIG. 11 is a partial plan view of the timepiece attached to the main band.
Figure 12:
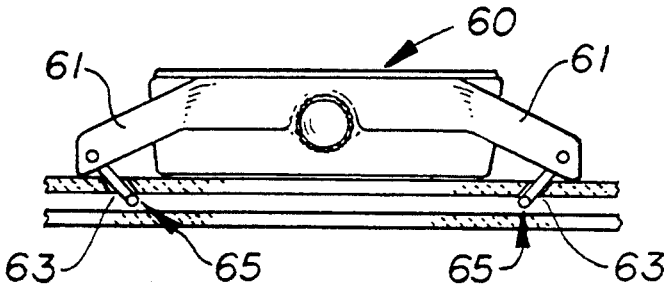
FIG. 12 is a partial cross-sectional view taken along line 12—12 in FIG. 11 showing the placement of the U-shaped attachment clip used to secure the timepiece to the main band.
Figure 13:
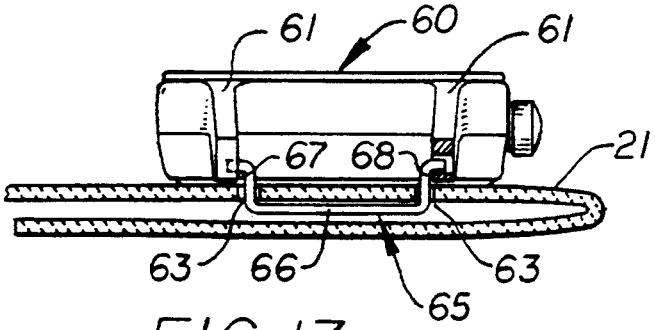
FIG. 13 is a partial cross-sectional view taken along line 13—13 in FIG. 11 showing the alignment of the two U-shaped attachment clips located on opposite sides of the body of the timepiece.

As shown in FIGS. 11–13, in the preferred embodiment the timepiece 60 is securely attached to the front panel 22 of the main band 21 by a timepiece attachment means which has a relatively simple design. In the preferred embodiment, the timepiece attachment means includes two U-shaped attachment clips 65 that extend through two pairs of holes 63 manufactured in the main band 21. The central portion 66 of each clip 65 is positioned on the inside surface 24 of the front panel 22 while the two arms 67, 68 extend through the holes 63 to engage the opposite pair of lugs 61 located on the body of the timepiece 60. The opposite sets of holes 63 are spaced apart so that the two U-shaped attachment clips 65 are slanted outward in opposite directions to prevent undesirable movement of the body of the timepiece 60 on the front panel 22.

In compliance with the statute, the invention has been described in language more or less specific as to structural features. It should be understood, however, that the invention is not limited to the specific features shown since the means and construction shown comprises the preferred forms of putting the invention into effect. The invention is, therefore, claimed in any of its forms or modifications within the legitimate and valid scope of the amended claims, appropriately interpreted in accordance with the doctrine of equivalents.

I claim:

1. A wrist watch wallet, comprising:

a. an elongated main band made of flexible material, said main band having a front panel with an outside surface and an inside surface, said main band having a first end and an opposite second end, said second end being closed to form a full-length main pocket inside said main band, said main band having a top rear flap and a bottom rear flap which converge to form a full-length longitudinally aligned opening into said main pocket, said first end of said main band being unattached thereby creating a transversely aligned opening into said main pocket;

b. a pair of primary hook and loop connector pads disposed on opposite sides of said main band near said first and second ends of said main band, each said connector pad having an upper and lower edge, said pair of primary hook and loop connector pads being capable of interconnecting when said main band is wrapped around a wrist of a user;

c. a timepiece attached to the front panel of said main band with a timepiece attachment means, said timepiece having a body with opposite pairs of lugs located thereon, and;

d. a rigid insert member disposed inside said main band along said second end, said insert member being capable of improving interconnection between said primary hook and loop connector pads.

2. A wrist watch wallet, as recited in claim 1, further comprising at least one slot manufactured on said front panel directly behind said connector pad attached to said front panel, said slot having a sufficient width to enable the shank of a key to be inserted therein.

3. A wrist watch wallet, as recited in claim 2, further comprising a channel formed in said connector pad attached to said front panel, said channel being capable of aligning said key in a traversely aligned position in said wrist watch wallet when inserted into said slot.

4. A wrist watch wallet, as recited in claim 3, further comprising openings formed along said upper and lower edges of said connector pad attached to said front surface which enable the end of a shank of a key to be extended therefrom.

5. A wrist watch wallet, as recited in claim 2, wherein said timepiece attachment means comprises a pair of U-shaped attachment clips that extend through said main band to engage said opposite pairs of lugs on said body of said timepiece, said U-shaped attachment clips being spaced apart and aligned so that movement of said timepiece over said main band is prevented.

6. A wrist watch wallet, as recited in claim 5, further including a second pocket formed inside said bottom flap.

7. A wrist watch wallet, as recited in claim 5, further including an auxiliary connector pad attached to said bottom rear flap adjacent to said primary connector pad attached near said second end of said main band, said auxiliary connector pad being capable of interconnecting with said primary connector pad on said front panel near said first end when said wrist watch wallet is attached to said wrist.

8. A wrist watch wallet, as recited in claim 5, further including a pair of secondary hook and loop connector pads located along the first end of said main band and disposed between said front panel and said bottom flap, said secondary hook and loop connectors being capable of selectively closing said transversely aligned opening into said main pocket.

9. A wrist watch wallet, comprising:

a. an elongated main band made of flexible material, said main band having a first panel with an outside surface and an inside surface, said main band having a first end and an opposite second end, said second end being closed to form a full-length main pocket inside said main band, said main band having a rear top flap and a rear bottom flap which converge to form a full-length, longitudinally aligned, opening into said main pocket, said first end of said main band being unattached thereby creating a transversely aligned opening into said main pocket;

b. a pair of primary connector pads disposed on opposite sides of said main band near said first and second ends of said main band, each pair of primary connector pads being capable of interconnecting when said second end of said main band is wrapped over said first end of said main band to attach said wrist watch wallet around a user's wrist;

c. a plurality of slots manufactured on said front panel directly behind said connector pad located on said front surface, said slots being capable of receiving a shank of a key thereby enabling said key to be stored on said wrist watch wallet;

d. a timepiece attached to said surface of said main body, said timepiece having a body with opposite pairs of lugs located thereon, said timepiece being attached using a pair of U-shaped attachment clips that extend through the main band to engage said opposite pairs of lugs on said body of said timepiece, and;

e. a rigid insert member disposed inside said main band along said second end, said insert member being sufficiently rigid to improve interconnection between said pair of primary connector pads.

10. A wrist watch wallet, as recited in claim 9, further including a second pocket formed on the inside surface of said main pocket.

11. A wrist watch wallet, as recited in claim 10, further comprising channels formed in said primary connector pad attached to said front surface, each said channel being capable of aligning said key in a traversely aligned position in said wrist watch wallet when inserted into said slot.

12. A wrist watch wallet, as recited in claim 11, further including an auxiliary connector pad attached to said bottom rear flap adjacent to said primary connector pad attached near said second end of said main band, said auxiliary connector pad being capable of interconnecting with said primary connector pad attached to said front panel when said second end of said main band is wrapped over said first end of said main band when said wrist watch wallet is attached to a user's wrist.

* * * * *